US011725912B2

(12) United States Patent
Kamphaus

(10) Patent No.: US 11,725,912 B2
(45) Date of Patent: Aug. 15, 2023

(54) MAGNETIC DARTBOARD

(71) Applicant: Jeff Kamphaus, Hamilton, OH (US)

(72) Inventor: Jeff Kamphaus, Hamilton, OH (US)

( * ) Notice: Subject to any disclaimer, the term of this patent is extended or adjusted under 35 U.S.C. 154(b) by 0 days.

(21) Appl. No.: 17/324,731

(22) Filed: May 19, 2021

(65) Prior Publication Data

US 2022/0113119 A1 Apr. 14, 2022

Related U.S. Application Data

(60) Provisional application No. 63/027,943, filed on May 20, 2020.

(51) Int. Cl.

| | |
|---|---|
| ***F41J 3/00*** | (2006.01) |
| ***A63B 65/02*** | (2006.01) |
| ***F42B 6/00*** | (2006.01) |

(52) U.S. Cl.

CPC ..... *F41J 3/0057* (2013.01); *F41J 3/0076* (2013.01); *F42B 6/003* (2013.01)

(58) Field of Classification Search

CPC ..... F42B 6/003; F41J 3/0057

See application file for complete search history.

(56) References Cited

U.S. PATENT DOCUMENTS

| | | | | |
|---|---|---|---|---|
| 2,683,037 A * | 7/1954 | Ruczynski | F42B 39/007 | 42/99 |
| 5,775,694 A * | 7/1998 | Jonsson | F41J 3/0057 | 273/348.3 |
| 6,062,997 A * | 5/2000 | Seymour | A63F 9/02 | 473/578 |
| 7,001,292 B1 * | 2/2006 | Rappaport | A63B 65/02 | 473/578 |
| 11,029,123 B1 * | 6/2021 | Andersen | A63F 9/0278 | |
| 2002/0084589 A1 * | 7/2002 | Shieh | F41J 3/0057 | 273/407 |
| 2007/0029732 A1 * | 2/2007 | Herrmann | F42B 6/003 | 473/578 |
| 2007/0080498 A1 * | 4/2007 | Yiu | F42B 6/003 | 273/348.3 |
| 2016/0038830 A1 * | 2/2016 | Merchant | A63F 9/0278 | 473/582 |

* cited by examiner

*Primary Examiner* — John A Ricci

(74) *Attorney, Agent, or Firm* — Cygnet IP Law, PA; Stephen W. Aycock, II

(57) ABSTRACT

A magnetic dartboard game system comprising a plurality of magnetic darts and a dartboard is described. In some implementations, the magnetic dartboard system comprises a dartboard having a backing portion, a metal layer portion, and a decorative cover portion. In some implementations, the magnetic dartboard system also comprises a magnetic dart having: a shaft body having a first end and a second end, said shaft body having a geometric shape with one or more tapers; a threaded cap, wherein the threaded cap is configured to thread onto the first end of the shaft body; a magnet having a first end and a second flat end, wherein the first end of the magnet rests on the second end of the threaded cap; and a balance tail fin with one or more vanes, wherein the balance tail fin is configured to attach to the shaft body of the magnetic dart.

20 Claims, 8 Drawing Sheets

700

MAGNETIC DARTBOARD

RELATED APPLICATIONS

This application claims the benefit of U.S. Application No. 63/027,943, entitled "Magnetic Dartboard," and filed on May 20, 2020, which is incorporated herein by reference in its entirety.

FIELD

Some implementations relate generally to a magnetic dartboard game system, and more particularly, to a magnetic dartboard game system (with darts) that is fun and safe to play with.

BACKGROUND

Some conventional dartboards may have predrilled holes that use darts with plastic tips that need to align with the predrilled holes in order for the dart to stick to the dartboard. This may cause a dart to not stick to the dartboard if not properly aligned. Another type of dartboard uses a sharp steel tip dart, which can be dangerous if not treated with caution. For example, such darts with sharp steel tips may accidentally injure a spectator when the dartboard is missed by the user.

Embodiments were conceived in light of the above-mentioned problems and limitations, among other things. The foregoing general description of the illustrative embodiments and the following detailed description thereof are merely exemplary aspects of the teachings of this disclosure and are not restrictive. The background description provided herein is for the purpose of generally presenting the context of this disclosure. Work of the presently named inventor(s), to the extent it is described in this background section as well as aspects of the description that may not otherwise qualify as prior art at the time of filing are neither expressly nor impliedly admitted as prior art against the present disclosure.

SUMMARY

In some implementations, a magnetic dartboard game system comprises a dartboard having a backing portion, a metal layer portion, and a decorative cover portion, and a magnetic dart. In some implementations, the magnetic dart has a shaft body, a threaded cap, a magnet, a magnet housing, and a balance tail fin. In some implementations, the shaft body has a first end and a second end. In some implementations, the shaft body has a geometric shape with a first taper, a second taper, and a third taper. In some implementations, the first end of the shaft body has threads. In some implementations, the second end of the shaft body has a first slot, a second slot, a third slot, and a fourth slot. In some implementations, the four slots are disposed at the third taper. In some implementations, the threaded cap is configured to thread onto the first end of the shaft body. In some implementations, the magnet has a first end and a second end. In some implementations, the first end of the magnet rests on the second end of the threaded cap. In some implementations, the magnet housing has a first end and a second end. In some implementations, the first end of the magnet housing is hollowed out, allowing it to slide over the magnet and the threaded cap. In some implementations, the second end has a radius edge with an opening.

In some implementations, an inner edge of the opening creates an interior lip. In some implementations, the interior lip provides a stop for the second end of the magnet. In some implementations, the opening exposes the magnet and prevents the magnet from protruding outside the second end of the magnet housing. In some implementations, the balance tail fin of the magnetic dart has a first end and a second end. In some implementations, the balance tail fin has a first vane, a second vane, a third vane, and a fourth vane, each having an angled portion, an outer edge, and a back edge. In some implementations, the four vanes are joined along a common interior axis and are offset from each other by an angle. In some implementations, the first end of the balance tail fin is constructed to slide into the second end of the shaft body such that the first vane is inserted into the first slot, the second vane is inserted into the second slot, the third vane is inserted into the third slot, and the fourth vane is inserted into the fourth slot.

In some implementations, the decorative cover portion of the magnetic dartboard game system is made of one or more of resin, plastic, metal, rubber, or fabric. In some implementations, the dartboard of the magnetic dartboard game system takes a shape of one or more of a rectangle, a square, a triangle, a circle, an oval, a pentagon, a hexagon, an octagon, or a rhombus. In some implementations, the magnet housing of the magnetic dart is affixed to the threaded cap using one or more of a threaded arrangement, a coupling system, or a riveting system. In some implementations, the shaft body of the magnetic dart takes a shape of one or more of a cylinder, a prism, or a cone. In some implementations, the magnet of the magnetic dart takes a shape of one or more of a cylinder, a prism, or a cone. In some implementations, one or more of the four slots of the magnetic dart may be aligned parallel to a lengthwise axis of the shaft body. In some implementations, one or more of the four slots of the magnetic dart may be oriented transverse at 90 degrees to a lengthwise axis of the shaft body.

In some implementations, a magnetic dartboard game system comprises a dartboard that further comprises a backing portion, a metal layer portion, and a decorative cover portion, and a magnetic dart. In some implementations, the magnetic dart comprises a shaft body, a threaded cap, a magnet, and a magnet housing. In some implementations, the shaft body has a first end and a second end. In some implementations, the shaft body has a geometric shape with a first taper, a second taper, and a third taper. In some implementations, the first end of the shaft body has threads. In some implementations, the second end of the shaft body has a first slot, a second slot, a third slot, and a fourth slot. In some implementations, the four slots are disposed at the third taper. In some implementations, the threaded cap is configured to thread onto the first end of the shaft body. In some implementations, the magnet has a first end and a second end. In some implementations, the first end of the magnet rests on the second end of the threaded cap.

In some implementations, the magnet housing has a first end and a second end. In some implementations, the first end of the magnet housing is hollowed out, allowing it to slide over the magnet and the threaded cap. In some implementations, the second end has a radius edge with an opening. In some implementations, the opening is smaller in size than that of the magnet housing and the magnet. In some implementations, an inner edge of the opening creates an interior lip. In some implementations, the interior lip provides a stop for the second end of the magnet. In some implementations, the opening exposes the magnet and prevents the magnet from protruding outside the second end of the magnet housing.

In some implementations, the decorative cover portion of the magnetic dartboard game system is made of one or more of resin, plastic, metal, rubber, or fabric. In some implementations, the dartboard of the magnetic dartboard game system takes a shape of one or more of a rectangle, a square, a triangle, a circle, an oval, a pentagon, a hexagon, an octagon, or a rhombus. In some implementations, the magnet housing of the magnetic dart is affixed to the threaded cap using one or more of a threaded arrangement, a coupling system, or a riveting system. In some implementations, the shaft body of the magnetic dart takes a shape of one or more of a cylinder, a prism, or a cone. In some implementations, the magnet of the magnetic dart takes a shape of one or more of a cylinder, a prism, or a cone. In some implementations, one or more of the four slots of the magnetic dart may be aligned parallel to a lengthwise axis of the shaft body. In some implementations, one or more of the four slots of the magnetic dart may be oriented transverse at 90 degrees to a lengthwise axis of the shaft body.

Some implementations may include a magnetic dartboard game system comprising a dartboard having a backing portion, a metal layer portion, and a decorative cover portion, and a plurality of magnetic darts. In some implementations, each magnetic dart may include a shaft body having a first end and a second end, wherein the shaft body has a geometric shape with a first taper, a second taper, and a third taper. In some implementations, the first end of the shaft body may include one or more threads. In some implementations, the second end of the shaft body may include a first slot, a second slot, a third slot, and a fourth slot. In some implementations, one or more of the four slots may be aligned parallel to a lengthwise axis of the shaft body. In some implementations, one or more of the four slots may be oriented transverse at 90 degrees to a lengthwise axis of the shaft body. In some implementations, the aforementioned four slots may be disposed at the third taper of the shaft body of the magnetic dart.

In some implementations, the magnetic dart may also include a cylindrical threaded cap. In some implementations, the cylindrical threaded cap may be configured to thread onto the first end of the shaft body. In some implementations, the magnetic dart may also include a cylindrical magnet. In some implementations, the cylindrical magnet may have a first end and a second flat end. In some implementations, the first end of the cylindrical magnet may rest on the second end of the cylindrical threaded cap. In some implementations, the magnetic dart may also include a magnet housing. In some implementations, the magnetic housing may have a first end and a second end. In some implementations, the first end of the magnet housing may be hollowed out, allowing it to slide over the cylindrical magnet and the cylindrical threaded cap. In some implementations, the second end may have a radius edge with a circular opening.

In some implementations, the circular opening may be smaller than an inner diameter of the magnet housing and an outer diameter of the cylindrical magnet. In some implementations, an inner edge of the circular opening may create an interior lip. In some implementations, the interior lip may provide a stop for the second end of the cylindrical magnet. In some implementations, the circular opening may expose the cylindrical magnet and prevent the cylindrical magnet from protruding outside the second end of the magnet housing.

The magnetic dart may further include a balance tail fin with a first end and a second end. In some implementations, the balance tail fin may have a first vane, a second vane, a third vane, and a fourth vane, each having an angled portion, an outer edge, and a back edge. In some implementations, the four vanes may be joined along a common interior axis and may be offset from each other by an angle. In some implementations, the first end of the balance tail fin may be constructed to slide into the second end of the shaft body such that the first vane is inserted into the first slot, the second vane is inserted into the second slot, the third vane is inserted into the third slot, and the fourth vane is inserted into the fourth slot. In some implementations, the four slots may belong to the second end of the shaft body.

In some implementations, the magnet housing of the magnetic dart is affixed to the threaded cap using one or more of a threaded arrangement, a coupling system, or a riveting system. In some implementations, one or more of the four slots of the magnetic dart may be aligned parallel to a lengthwise axis of the shaft body. In some implementations, one or more of the four slots of the magnetic dart may be oriented transverse at 90 degrees to a lengthwise axis of the shaft body.

BRIEF DESCRIPTION OF THE DRAWINGS

In the drawings, like reference numerals designate identical or corresponding parts throughout the several views. Further, as used herein, the words "a," "an," and the like generally carry a meaning of "one or more," unless stated otherwise. The drawings are generally not drawn to scale unless specified otherwise and when illustrating schematic structures or flowcharts. A more complete appreciation of this disclosure and many of the attendant advantages thereof will be readily obtained as the same becomes better understood by reference to the following detailed description when considered in connection with the accompanying drawings herein, wherein.

DETAILED DESCRIPTION

Some implementations can include a magnetic dartboard game system with a flattened magnetic dart tip for the safety of those in the path of the dart. The dart can include an arrow shaped body portion having a magnet on one end and a plurality of tail fins on the other end.

Figure 1:
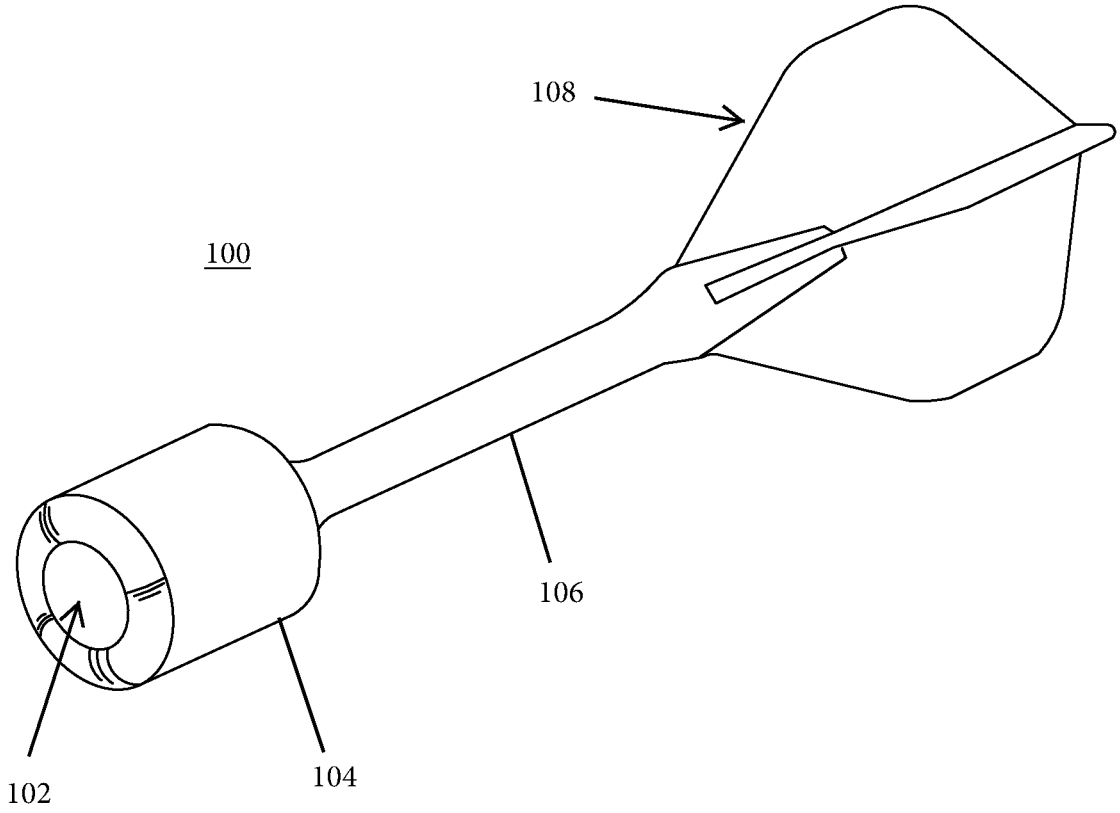
FIG. 1 is a diagram showing a side perspective view of an example magnetic dart in accordance with some implementations.

FIG. 1 is a diagram showing a side perspective view of an example magnetic dart in accordance with some implementations. The magnetic dart 100 shown includes a shaft body portion 106, a magnet housing 104, a magnet 102, and a balance tail fin 108. In some implementations, the magnet may take a shape of one or more of a cylinder, a prism, or a cone.

Figure 2:
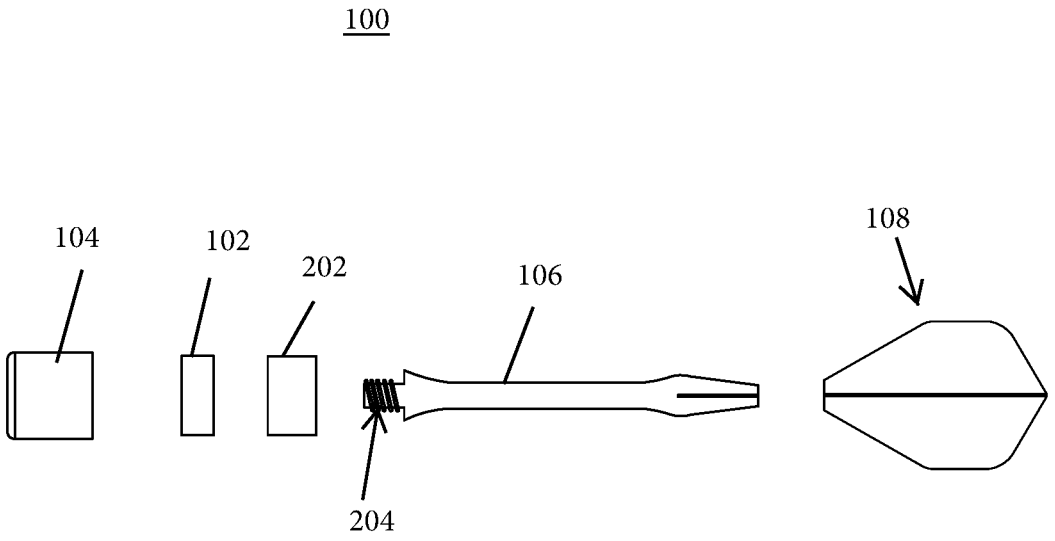
FIG. 2 is a diagram showing an exploded view of an example magnetic dart in accordance with some implementations.

FIG. 2 is a diagram showing an exploded view of an example magnetic dart in accordance with some implementations. The magnetic dart 100 includes a shaft body portion 106 with threads 204 (e.g., male threads) to fasten a cylindrical threaded cap 202 to the shaft body portion 106, a balance tail fin 108, a cylindrical magnet 102, and a magnet housing 104.

Figure 3:
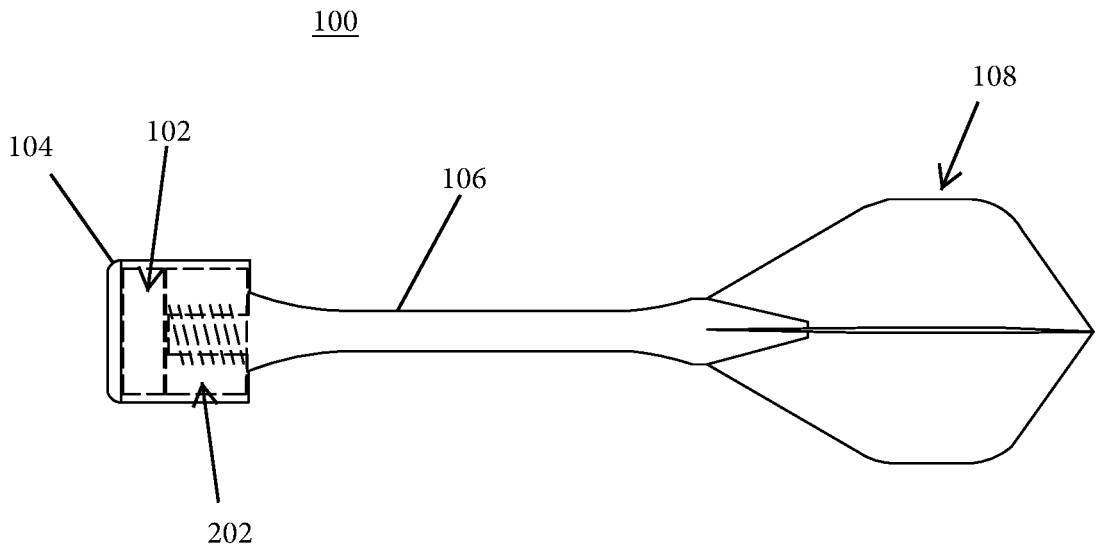
FIG. 3 is a diagram showing a side view with hidden lines of internals of an example magnetic dart in accordance with some implementations.

FIG. 3 is a diagram showing a side view with hidden lines of internals of an example magnetic dart in accordance with some implementations. The magnetic dart 100 includes a shaft body portion 106, a cylindrical threaded cap 202 threaded to the shaft body portion 106, a cylindrical magnet 102, a magnet housing 104, and a balance tail fin 108. In some implementations, the magnet has a first end and a second end (which may be flat in some cases).

In some implementations, the magnet housing 104 includes a first end and a second end. The first end of the magnet housing 104 may be hollowed out, thus allowing it to slide over the cylindrical magnet 102 and the cylindrical threaded cap 202. The second end may include a radius edge with a circular opening that is smaller than an inner diameter of the magnet housing 104 and an outer diameter of the cylindrical magnet 102. An inner edge of the circular opening may create an interior lip, such that the interior lip provides a stop for the second end of the cylindrical magnet 102. The circular opening may expose the cylindrical magnet 102 and may prevent the cylindrical magnet 102 from protruding outside the second end of the magnet housing 104. By preventing the cylindrical magnet 102 from protruding from the magnet housing 104, the magnet housing radius edge (and not the cylindrical magnet 102) contacts the dartboard when a dart is magnetically held in place on the dartboard. This feature may help prevent the magnetic darts from wearing out magnet 102 or damaging the decorative cover portion of the dartboard when darts attach magnetically to the dartboard or are removed from the dartboard.

In some implementations, an adhesive may be used to secure the magnet housing 104 to the cylindrical threaded cap 202. Other attachment types can be used, such as a threaded arrangement, a coupling system, a riveting system, or any other suitable technique.

Figure 4:
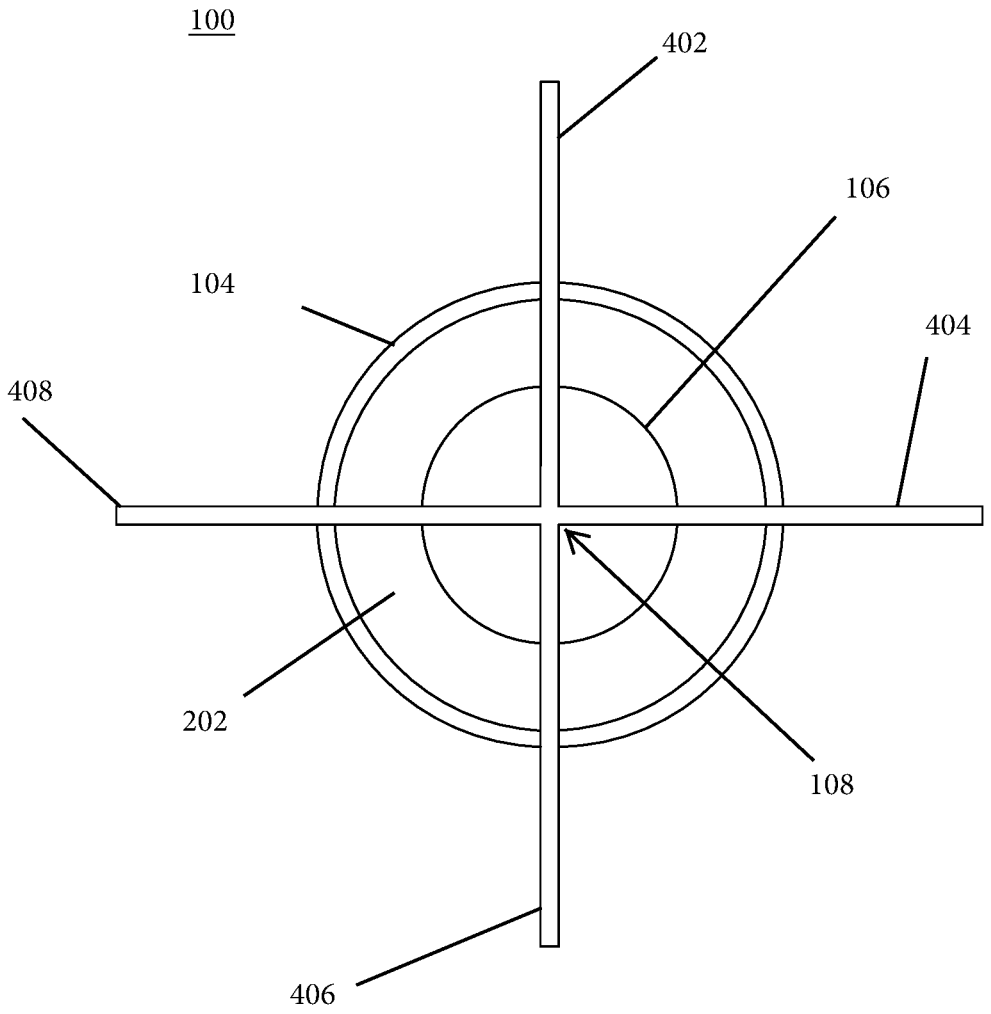
FIG. 4 is a diagram showing a rear view of an example magnetic dart in accordance with some implementations.

FIG. 4 is a diagram showing a rear view of an example magnetic dart in accordance with some implementations. The magnetic dart 100 includes a shaft body portion 106, a cylindrical threaded cap 202, a magnet housing 104, and a balance tail fin 108 with a first vane 402, a second vane 404, a third vane 406, and a fourth vane 408.

In some implementations, the balance fin can include two parts, with a first balance tail fin portion having a first end and a second end, where the first end slides into one of the slots on the second end of the shaft body and where the second end has a slot half way up to the center. The balance fin can also include a second balance tail fin having an arrow shape with a first end and a second end, where the first end having a slot half way up to the center that slides over the center of the first balance tail fin and into one of the slots on the second end of the shaft body.

Figure 5:
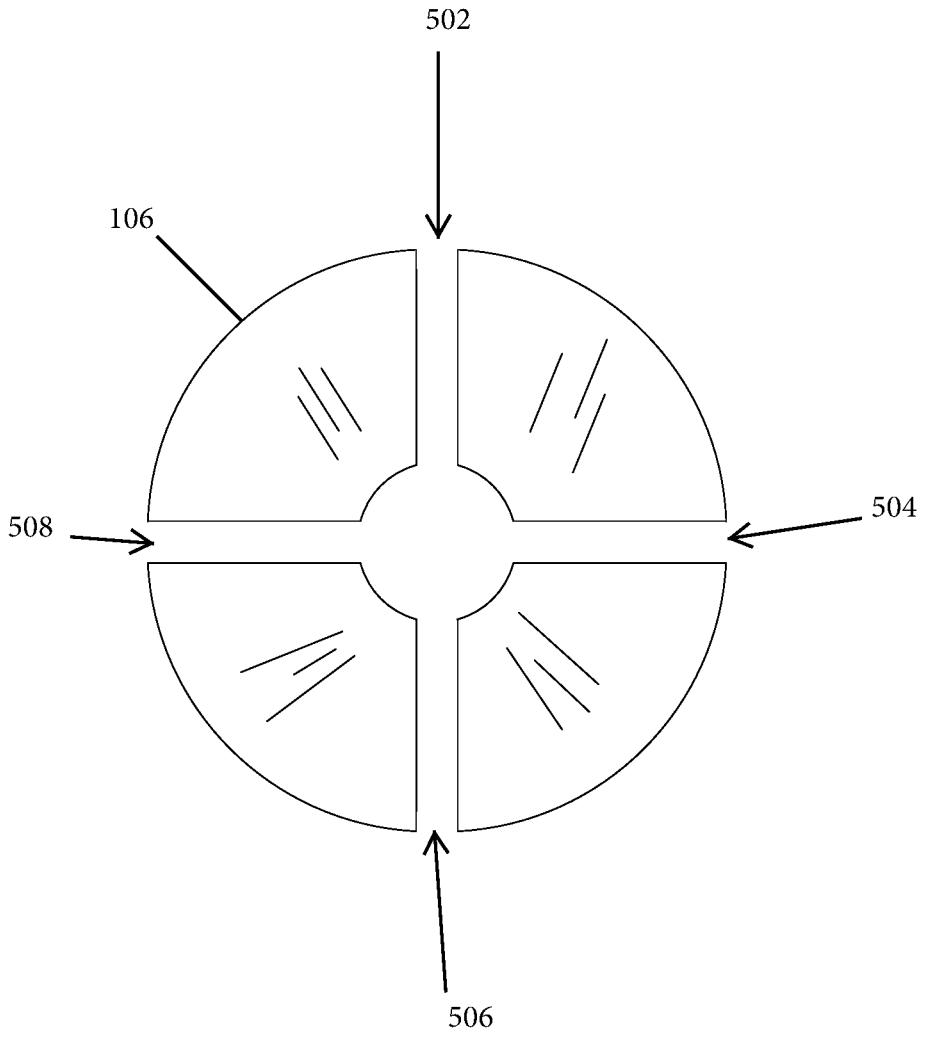
FIG. 5 is a diagram showing a rear view of an example magnetic dart shaft in accordance with some implementations.

FIG. 5 is a diagram showing a rear view of an example magnetic dart shaft body portion 106 in accordance with some implementations. In particular, FIG. 5 shows a shaft body portion 106 with a first slot 502, a second slot 504, a third slot 506, and a fourth slot 508. In some implementations, the shaft body takes a shape of one or more of a cylinder, a prism, or a cone.

Figure 6:
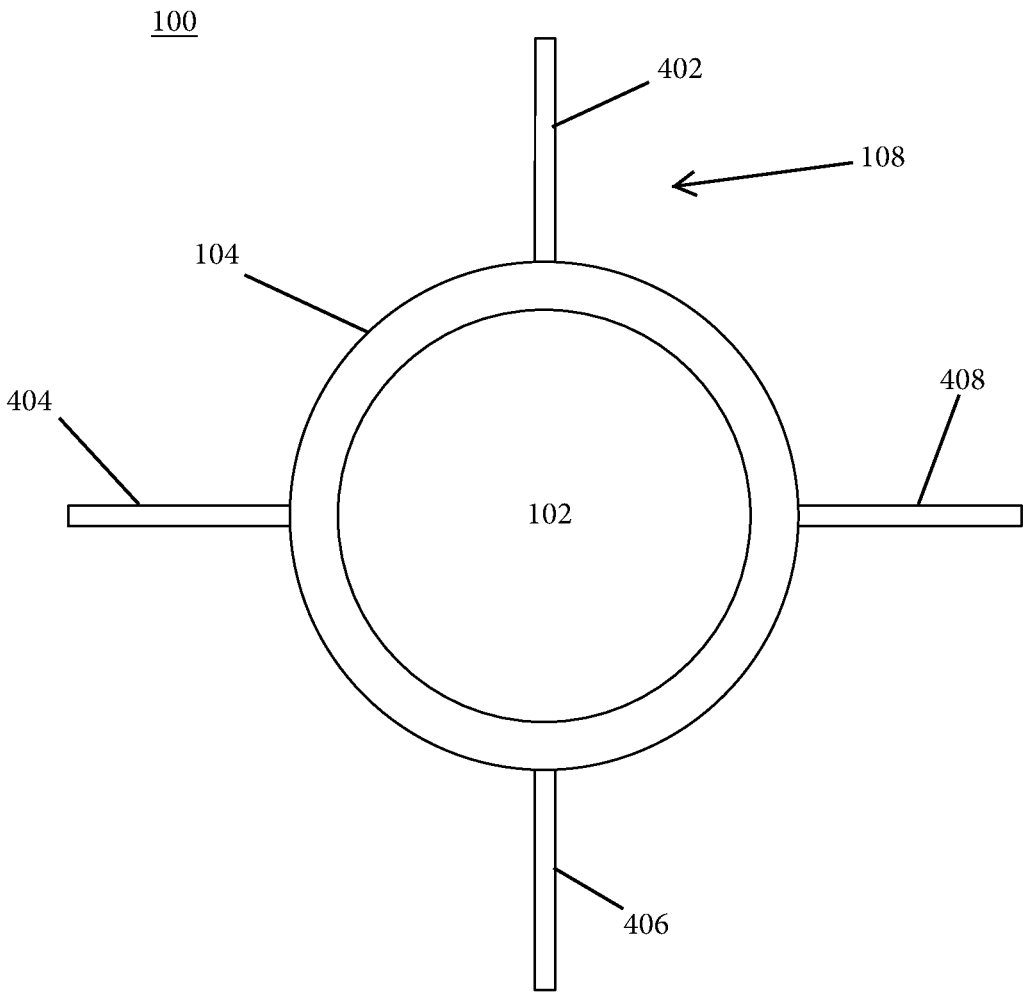
FIG. 6 is a diagram showing a front view of an example magnetic dart in accordance with some implementations.

FIG. 6 is a diagram showing a front view of an example magnetic dart in accordance with some implementations. The magnetic dart 100 includes a cylindrical magnet 102, a magnet housing 104, and a balance tail fin 108 with a first vane 402, a second vane 404, a third vane 406, and a fourth vane 408.

Figure 7:
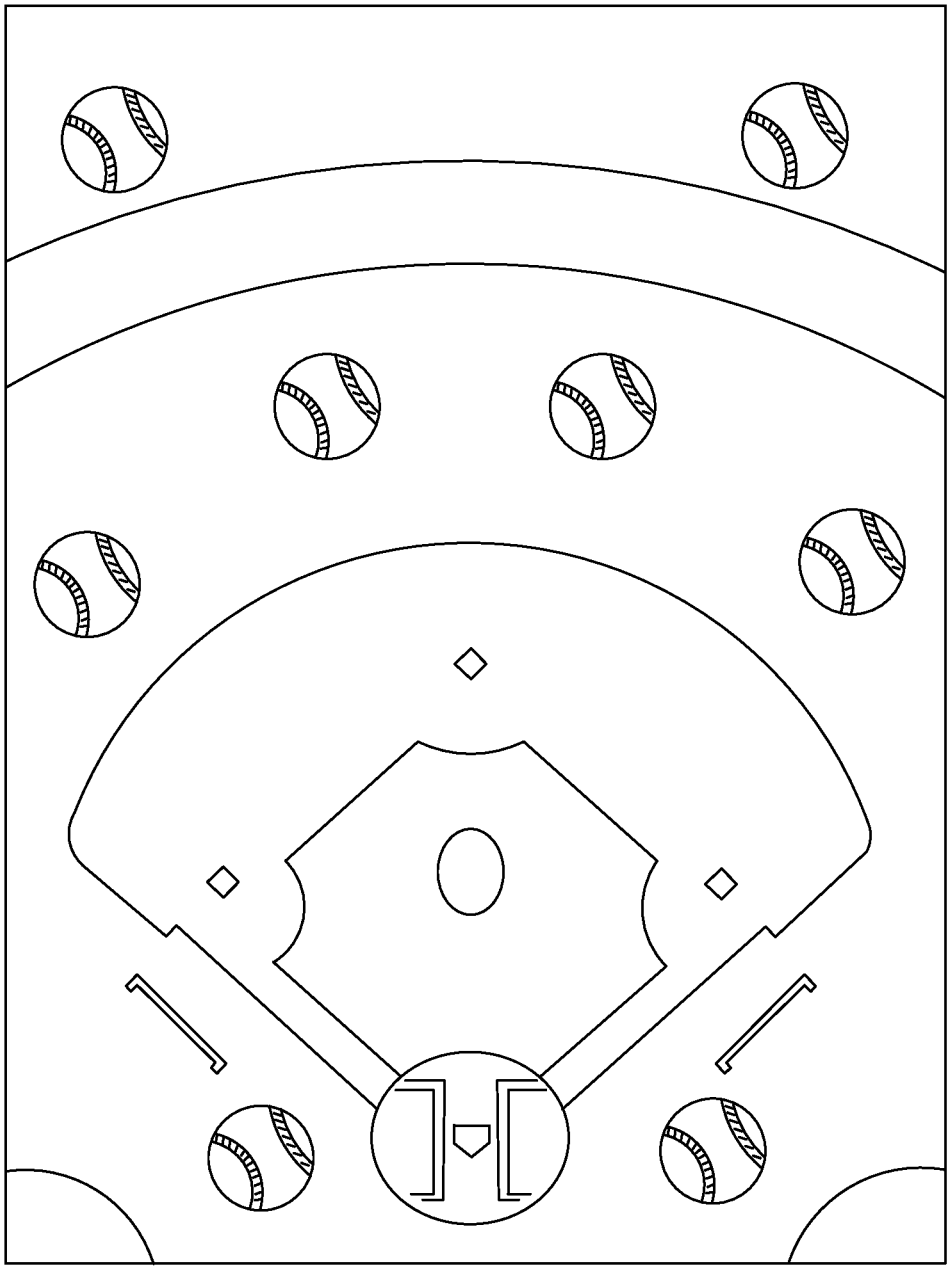
FIG. 7 is a diagram of a front view of an example magnetic dartboard in accordance with some implementations.

FIG. 7 is a diagram of a front view of an example magnetic dartboard in accordance with some implementations. The magnetic dartboard 700 shows an example baseball dart game, but different types of covers can be used to build other types of dartboard games known in the art.

The magnetic dartboard 700 is an example of a baseball dart game having a rectangular shape, but the dartboard can take any other shape known in the art. For example, the dartboard may take a shape of one or more of a rectangle, a square, a triangle, a circle, an oval, a pentagon, a hexagon, an octagon, or a rhombus. In some implementations, the dartboard may take the shape of a rectangle with dimensions of about 16"×24" (inches) or about 24"×38" (inches).

Figure 8:
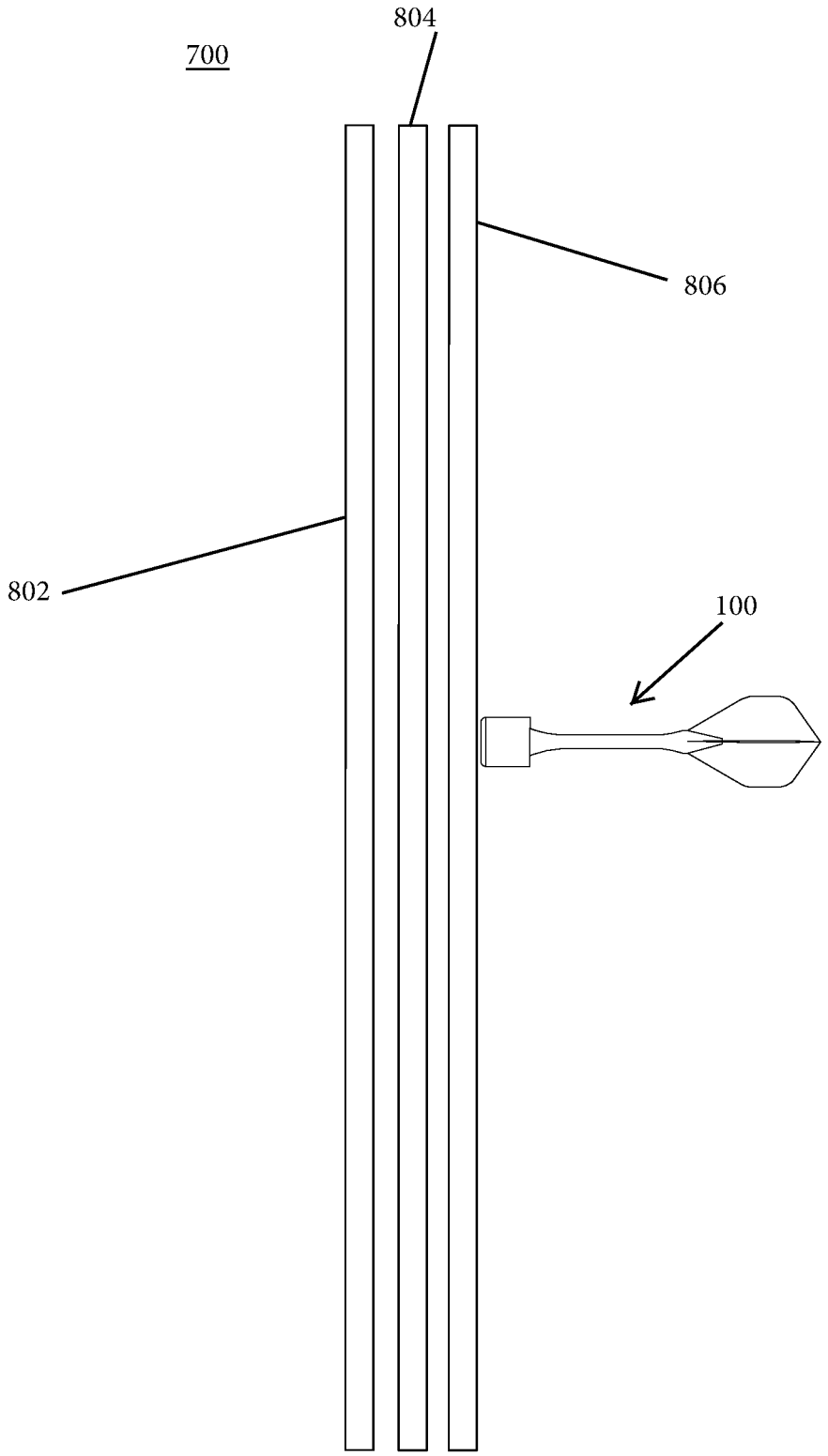
FIG. 8 is an exploded side view of an example magnetic dartboard in accordance with some implementations.

FIG. 8 is a diagram showing an exploded side view of layers making up an example magnetic dartboard and an example magnetic dart in accordance with some implementations. In particular, FIG. 8 shows a magnetic dart 100 as well as a magnetic dartboard 700 including a backing portion 802, a metal layer portion 804, and a decorative cover portion 806.

In some implementations, the decorative cover portion 806 may be made of vinyl with graphics printed on it. The decorative cover portion 806 can be applied to the metal layer portion 804, which is then attached to the backing portion 802. In some implementations, the decorative cover portion 806 may also be made of one or more of resin, plastic, metal, rubber, and/or fabric.

In some implementations, a magnetic dartboard game system may comprise a dartboard having a backing portion, a metal layer portion, and a decorative cover portion, and a magnetic dart. In some implementations, the magnetic dart may comprise a shaft body, a threaded cap, a magnet, a magnet housing, and a balance tail fin. In some implementations, the shaft body may have a first end with threads (e.g., male threads) and a second end. In some implementations, the shaft body may have a geometric shape with a first taper, a second taper, and a third taper. In some implementations, the second end of the shaft body may have a first slot, a second slot, a third slot, and a fourth slot. In some implementations, these four slots may be disposed at the third taper. In some implementations, the threaded cap may be configured to thread onto the first end of the shaft body. In some implementations, the magnet may have a first end and a second end. In some implementations, the first end of the magnet may rest on the second end of the threaded cap. In some implementations, the magnet housing may have a first end and a second end. In some implementations, the first end of the magnet housing may be hollowed out, thereby allowing it to slide over the magnet and the threaded cap. In some implementations, the second end may have a radius edge with an opening. In some implementations, an inner edge of the opening may create an interior lip, which may provide a stop for the second end of the magnet. In some implementations, the opening may expose the magnet and may prevent the magnet from protruding outside the second end of the magnet housing. In some implementations, the balance tail fin of the magnetic dart may have a first end and a second end. In some implementations, the balance tail fin may have a first vane, a second vane, a third vane, and a fourth vane. Each of the vanes may have an angled portion, an outer edge, and/or a back edge in some implementations. These four vanes may be joined along a common interior axis and may be offset from each other by an angle in some implementations. In some implementations, the first end of the balance tail fin may be constructed so as to slide into the second end of the shaft body such that the first vane is inserted into the first slot, the second vane is inserted into the second slot, the third vane is inserted into the third slot, and the fourth vane is inserted into the fourth slot of the shaft body.

While some implementations have been described in terms of a general embodiment with several specific modifications, it is recognized that persons skilled in this art will readily perceive many other modifications and variations of the embodiments described above within the spirit and scope of the disclosed subject matter. Applicants intend to embrace any and all such modifications, variations, and embodiments.

What is claimed is:

1. A magnetic dartboard game system comprising:

a dartboard comprising a backing portion, a metal layer portion, and a decorative cover portion; and a magnetic dart comprising:

a shaft body with a first end and a second end, wherein the shaft body has a geometric shape with a first taper, a second taper, and a third taper, wherein the first end of the shaft body has threads, wherein the second end of the shaft body has a first slot, a second slot, a third slot, and a fourth slot, and wherein the four slots are disposed at the third taper;

a threaded cap, wherein a first end of the threaded cap is configured to thread onto the first end of the shaft body;

a magnet with a first end and a second end, wherein the first end of the magnet rests on a second end of the threaded cap;

a magnet housing with a first end and a second end, wherein the first end of the magnet housing is hollowed out, allowing it to slide over the magnet and the threaded cap, wherein the second end has a radius edge with an opening, wherein an inner edge of the opening creates an interior lip, wherein the interior lip provides a stop for the second end of the magnet, wherein the opening exposes the magnet and prevents the magnet from protruding outside the second end of the magnet housing; and a balance tail fin with a first end and a second end, wherein the balance tail fin has a first vane, a second vane, a third vane, and a fourth vane, each having an angled portion, an outer edge, and a back edge, wherein the four vanes are joined along a common interior axis and are offset from each other by an angle, wherein the first end of the balance tail fin is constructed to slide into the second end of the shaft body such that the first vane is inserted into the first slot, the second vane is inserted into the second slot, the third vane is inserted into the third slot, and the fourth vane is inserted into the fourth slot.

2. The magnetic dartboard game system of claim 1, wherein the decorative cover portion is made of one or more of resin, plastic, metal, rubber, or fabric.

3. The magnetic dartboard game system of claim 1, wherein the dartboard takes a shape of one or more of a rectangle, a square, a triangle, a circle, an oval, a pentagon, a hexagon, an octagon, or a rhombus.

4. The magnetic dartboard game system of claim 1, wherein the magnet housing is affixed to the threaded cap using one or more of a threaded arrangement, a coupling system, or a riveting system.

5. The magnetic dartboard game system of claim 1, wherein the shaft body takes a shape of one or more of a cylinder, a prism, or a cone.

6. The magnetic dartboard game system of claim 1, wherein the magnet takes a shape of one or more of a cylinder, a prism, or a cone.

7. The magnetic dartboard game system of claim 1, wherein one or more of the four slots are aligned parallel to a lengthwise axis of the shaft body.

8. The magnetic dartboard game system of claim 1, wherein one or more of the four slots are oriented transverse at 90 degrees to a lengthwise axis of the shaft body.

9. A magnetic dartboard game system comprising:

a dartboard comprising a backing portion, a metal layer portion, and a decorative cover portion; and a magnetic dart comprising:

a shaft body with a first end and a second end, wherein the shaft body has a geometric shape with a first taper, a second taper, and a third taper, wherein the first end of the shaft body has threads, wherein the second end of the shaft body has a first slot, a second slot, a third slot, and a fourth slot, and wherein the four slots are disposed at the third taper;

a threaded cap, wherein a first end of the threaded cap is configured to thread onto the first end of the shaft body;

a magnet having a first end and a second end, wherein the first end of the magnet rests on a second end of the threaded cap; and a magnet housing with a first end and a second end, wherein the first end of the magnet housing is hollowed out, allowing it to slide over the magnet and the threaded cap, wherein the second end has a radius edge with an opening, wherein the opening is smaller in size than that of the magnet housing and the magnet, wherein an inner edge of the opening creates an interior lip, wherein the interior lip provides a stop for the second end of the magnet, and wherein the opening exposes the magnet and prevents the magnet from protruding outside the second end of the magnet housing.

10. The magnetic dartboard game system of claim 9, wherein the decorative cover portion is made of one or more of resin, plastic, metal, rubber, or fabric.

11. The magnetic dartboard game system of claim 9, wherein the dartboard takes a shape of one or more of a rectangle, a square, a triangle, a circle, an oval, a pentagon, a hexagon, an octagon, or a rhombus.

12. The magnetic dartboard game system of claim 9, wherein the magnet housing is affixed to the threaded cap using one or more of a threaded arrangement, a coupling system, or a riveting system.

13. The magnetic dartboard game system of claim 9, wherein the shaft body takes a shape of one or more of a cylinder, a prism, or a cone.

14. The magnetic dartboard game system of claim 9, wherein the magnet takes a shape of one or more of a cylinder, a prism, or a cone.

15. The magnetic dartboard game system of claim 9, wherein one or more of the four slots are aligned parallel to a lengthwise axis of the shaft body.

16. The magnetic dartboard game system of claim 9, wherein one or more of the four slots are oriented transverse at 90 degrees to a lengthwise axis of the shaft body.

17. A magnetic dartboard game system comprising:

a dartboard comprising a backing portion, a metal layer portion, and a decorative cover portion; and a magnetic dart comprising:

a shaft body with a first end and a second end, wherein the shaft body has a geometric shape with a first taper, a second taper, and a third taper, wherein the first end of the shaft body has threads, wherein the second end of the shaft body has a first slot, a second slot, a third slot, and a fourth slot, and wherein the four slots are disposed at the third taper;

a cylindrical threaded cap, wherein a first end of the cylindrical threaded cap is configured to thread onto the first end of the shaft body;

a cylindrical magnet with a first end and a second flat end, wherein the first end of the cylindrical magnet rests on a second end of the cylindrical threaded cap;

a magnet housing with a first end and a second end, wherein the first end of the magnet housing is hollowed out, allowing it to slide over the cylindrical magnet and the cylindrical threaded cap, wherein the second end has a radius edge with a circular opening, wherein the circular opening is smaller than an inner diameter of the magnet housing and an outer diameter of the cylindrical magnet, wherein an inner edge of the circular opening creates an interior lip, wherein the interior lip provides a stop for the second end of the cylindrical magnet, and wherein the circular opening exposes the cylindrical magnet and prevents the cylindrical magnet from protruding outside the second end of the magnet housing; and a balance tail fin with a first end and a second end, wherein the balance tail fin has a first vane, a second vane, a third vane, and a fourth vane, each having an angled portion, an outer edge, and a back edge, wherein the four vanes are joined along a common interior axis and are offset from each other by an angle, wherein the first end of the balance tail fin is constructed to slide into the second end of the shaft body such that the first vane is inserted into the first slot, the second vane is inserted into the second slot, the third vane is inserted into the third slot, and the fourth vane is inserted into the fourth slot.

18. The magnetic dartboard game system of claim 17, wherein one or more of the four slots are aligned parallel to a lengthwise axis of the shaft body.

19. The magnetic dartboard game system of claim 17, wherein one or more of the four slots are oriented transverse at 90 degrees to a lengthwise axis of the shaft body.

20. The magnetic dartboard game system of claim 17, wherein the magnet housing is affixed to the cylindrical threaded cap using one or more of a threaded arrangement, a coupling system, or a riveting system.

* * * * *